US005091645A

United States Patent [19]

Elliott

[11] Patent Number: 5,091,645

[45] Date of Patent: Feb. 25, 1992

[54] SELECTABLE-RESOLUTION CHARGED-PARTICLE BEAM ANALYZERS

[75] Inventor: Richard M. Elliott, Sale, United Kingdom

[73] Assignee: VG Instruments Group Limited, Crawley, England

[21] Appl. No.: 629,248

[22] Filed: Dec. 18, 1990

[30] Foreign Application Priority Data

Dec. 22, 1989 [GB] United Kingdom ..... 8929029

[51] Int. Cl.[5] ..... H01J 49/26

[52] U.S. Cl. ..... 250/305; 250/294; 250/295

[58] Field of Search ..... 250/281, 288 A, 305, 250/294, 295, 296, 298, 299

[56] References Cited

U.S. PATENT DOCUMENTS 3,546,450 12/1970 Burns ..... 250/281
3,655,963 4/1972 Brunnée et al. ..... 250/281
4,213,051 7/1980 Struthoff ..... 250/457
4,595,831 6/1986 Hetherington, Jr. et al. ..... 250/281
4,612,440 9/1986 Brunnée et al. ..... 250/281

FOREIGN PATENT DOCUMENTS 0041583 3/1977 Japan ..... 250/281

*Primary Examiner*—Jack I. Berman
*Assistant Examiner*—James E. Beyer
*Attorney, Agent, or Firm*—Chilton, Alix & Van Kirk

[57] ABSTRACT

A method of selecting the resolution of a charged-particle energy or momentum analyzer wherein an analyzing field disperses the particles in an analyzing plane. An electrostatic field generator is adjusted to cause the dispersed particles leaving the field to pass through either of two apertures formed in a resolving aperture member and disposed at different distances from the plane. Each aperture has a different width, selected to result in a different resolution of the analyzing field. A single means for receiving charged particles (typically an ion or electron detector) is disposed to receive particles which have passed through either aperture. A magnetic sector mass spectrometer incorporating the method is also disclosed.

18 Claims, 4 Drawing Sheets

SELECTABLE-RESOLUTION CHARGED-PARTICLE BEAM ANALYZERS

BACKGROUND OF THE INVENTION

1. Field of the Invention

This invention relates to a method and apparatus for selecting the momentum or energy resolution of a charged-particle momentum or energy analyzer which relies on the dispersion of a charged-particle beam and which uses a resolving aperture to define the resolution. In particular, the present invention relates to a method and apparatus for selecting the resolution of a magnetic sector mass spectrometer.

2. Description of the Prior Art

Conventional charged-particle beam energy or momentum analyzers (eg, electrostatic sector or magnetic sector analyzers) cause dispersion of the beam along a dispersion axis, so that the energy or momentum resolution may be determined by the width along that axis of a resolving aperture through which particles having an energy or momentum within a certain range may pass to a detector. Most such analyzers also possess focusing properties along the dispersion axis such that there exists an image plane in which an image of an object (typically defined by an entrance aperture located in an object plane) is formed. Conventionally, the resolving aperture is located in the image plane, resulting in the maximum possible transmission for a particular resolution.

In such a conventional analyzer, varying the width of the resolving aperture changes the resolution of the analyzer (at least within certain limits), but as the width is reduced to increase the resolution the number of charged particles passing through the aperture also may be reduced. Many analyzers of this type therefore incorporate a variable-width resolving aperture (usually a slit) in order to provide adjustable resolution. This allows the analyzer to be operated at either high resolution with low transmission or at low resolution with high transmission. In many cases a continuously adjustable slit is provided, especially in mass spectrometers incorporating magnetic and/or electrostatic sector analyzers. Usually, a mechanism is provided which allows the width of the slit to be adjusted from outside the vacuum envelope of the analyzer.

Many such slit-adjusting mechanisms are known (see, for example, U.S. Pat. Nos. 4,612,440, 3,655,963, 3,546,450 and 3,187,179). Mechanisms which allow both the width and the position of the aperture along the dispersion axis to be adjusted are also known, for example, U.S. Pat. No. 4,213,051. All such adjustable aperture mechanisms involve either a mechanical linkage which transfers motion from outside the vacuum housing to the aperture jaws or an electrical transducer which converts an electrical signal directly into the jaw movement (eg, a bimetallic strip or a piezoelectric device). It is also known to provide several apertures of different sizes, for example in a sliding plate arranged so that any selected one of the apertures can be brought into use by moving the plate. See, for example, U.S. Pat. No. 4,595,831 which discloses such an arrangement for use in a multi-collector isotope-ratio mass spectrometer. In this spectrometer, each position of the plate brings several apertures into use simultaneously, each aligned with a collector which therefore receives ions of a particular mass-to-charge ratio. All these prior resolution adjusting or selecting systems require sliding or rotating parts operating in high vacuum, and although the prior devices have been developed to such a degree that regular use is possible without repeated failures, the difficulty of achieving reliable operation is considerable. Further, the speed at which the width of the aperture can be changed is inherently limited, even when the mechanism is driven by a solenoid or motor. Several attempts have therefore been made to provide an aperture of variable effective width which does not involve moving components, (see, for example, the zoom electrostatic lens arrangement operated in conjunction with a fixed aperture described in GB patent 1,318,200). Unfortunately, use of such a system often results in an increase in focusing aberrations which can limit the ultimate resolution of the analyzer.

Also relevant to this invention-is a prior detector system for a mass spectrometer described in the brochure "Finnigan MAT MAT9OO Mass Spectrometer", published 1989 by Finnigan MAT, W.Germany. This detector system incorporates an electron multiplier type detector operated in conjunction with a single fixed resolving aperture and a position sensitive multichannel detector. The two detectors are selected by electrostatically deflecting the beam towards the selected detector. It does not provide a selectable resolution spectrometer or analyzer which is the object of the present invention, but rather a means of selecting two different detectors.

SUMMARY OF THE INVENTION

It is an object of the invention to provide a method of selecting the resolution of a charged-particle energy or momentum analyzer without moving any components within the vacuum envelope of the analyzer. It is another object to provide charged-particle analyzers which operate according to the method. It is another object to provide selectable-resolution mass spectrometers which operate according to the method.

In accordance with these objectives the invention provides a method of analyzing a beam of charged particles according to a property chosen from the group comprising energy and momentum, said method comprising:

a) causing the charged particles to enter an analyzing field wherein they are dispersed according to the chosen property in an analyzing plane but are not substantially dispersed in a direction perpendicular to said analyzing plane, and b) passing at least some of the charged particles leaving said analyzing field through an aperture whose width is chosen to determine the resolution of said analyzing field with respect to said chosen property, the improvement wherein at least some of the charged particles leaving said analyzing field are directed through any selected one of a plurality of said apertures of different widths spaced at different distances from said analyzing plane, whereby the resolution of said analyzing field may be varied according to which said aperture is selected.

In a preferred method charged particles which pass through either of two of said plurality of apertures are further directed to a single means for receiving charged particles. The means for receiving may comprise a charged-particle detector or may be an arrangement of lenses for transmitting the particles to another analyzer. Further, if said plurality of apertures comprises more than two apertures, it is preferable that charged particles passing through any of them are directed to the same means for receiving.

In this way the resolution of the analyzing field can be changed by directing the dispersed beam through any one of several apertures of different sizes and subsequently receiving the beam on a single detector.

The invention may provide a method wherein the chosen property is energy and the analyzing field is an electrostatic field, or it may provide a method wherein the chosen property is momentum and the analyzing field is a magnetic field. The invention may further provide a method of mass spectral analysis of a beam of ions comprising an analyzing field wherein the mass resolution may be selected in the manner described. In this latter method, the analyzing field may comprise a magnetic field or both electrostatic and magnetic fields, or combinations of more than one electrostatic and/or more than one magnetic field, through which the ions pass sequentially. Alternatively, at least one element of the analyzing field may comprise crossed electrostatic and magnetic fields, for example, a Wien filter.

In still further preferred methods, the analyzing field of the invention possesses focusing properties such that an image focused along at least one axis is formed in an image plane from an object comprising the source of charged particles being analyzed. In such a case, the resolving aperture member of the invention may advantageously be disposed in the image plane.

Viewed from another aspect the invention provides a selectable-resolution analyzer for analyzing a beam of charged particles according to a property chosen from the group comprising energy and momentum, said analyzer comprising:

a) means for creating an analyzing field which disperses said particles according to said property in an analyzing plane but does not substantially disperse said charged particles in a direction perpendicular to said analyzing plane;

b) means for causing a beam of charged particles to enter said analyzing field and to be dispersed therein according to said chosen property; and c) a resolving aperture member disposed at the exit of said analyzing field comprising at least an aperture whose width is chosen to determine the resolution of said analyzing field with respect to said property, through which aperture pass at least some charged particles after they have left said analyzing field;

the improvement comprising a) the provision in said resolving aperture member of a plurality of said apertures of different width each spaced at a different distance from said analyzing plane, and b) means for directing at least some of the charged particles leaving said analyzing field through any selected one of said plurality of apertures whereby the resolution of said analyzer may be determined according to which of said apertures is selected.

A preferred analyzer according to the invention further comprises a single means for receiving charged particles which have passed through either of two of the plurality of apertures. The means for receiving may comprise a charged-particle detector, or may comprise an arrangement of lenses for transmitting the charged particles to another analyzer. Where more than two apertures are present in the resolving aperture member, the means for receiving is preferably capable of receiving charged particles which have passed through any of the apertures.

An analyzer according to the invention may be an energy analyzer and comprise means for generating an electrostatic analyzing field, or it may be a momentum analyzer and comprise means for generating a magnetic field. The analyzing field may also comprise two or more electrostatic or magnetic fields through which the charged particles may travel sequentially. In these cases the resolving aperture member may be disposed so that the apertures in it may define the resolution of any one or of any combination of the fields. It is also within the scope of the invention to provide means for creating an analyzing field consisting of crossed electrostatic and magnetic fields, for example a Wien filter.

According to another aspect the invention provides a selectable-resolution mass spectrometer comprising:

a) means for generating a beam of ions and accelerating them to a substantially constant energy; and b) a selectable-resolution analyzer substantially as defined above wherein said analyzing field is a magnetic field, said chosen property is momentum, and each said aperture in said resolving aperture member has a width selected to define a particular mass resolution of said analyzer.

In a preferred spectrometer according to the invention a single means for detecting ions is provided to detect ions which have passed through either of two of the plurality of apertures. If more than two apertures are provided, the means for detecting ions should preferably be capable of detecting ions which have passed through any of the apertures, but it is also within the scope of the invention to provide further detecting means for detecting ions which have passed through apertures other than the two associated with the first detecting means.

In further preferred analyzers or spectrometers, the analyzing field may possess focusing properties which result in the formation of an image focused at least along one axis in an image plane. In such a case the resolving aperture member may advantageously be disposed so that at least one of the apertures is located in that image plane In any analyzer or spectrometer as described the apertures in the resolving aperture member are conveniently disposed one above the other along an axis substantially perpendicular to the analyzing plane, and the means for directing the charged particles leaving the analyzing field may comprise an electrostatic field in the same direction as that axis. In this way the charged particles may be directed through the desired aperture without appreciably affecting the dispersion of the beam in the analyzing plane. The resolution of the analyzer can therefore be changed almost instantaneously by adjusting the electrostatic field to direct the beam through any desired aperture and subsequently detecting the charged particles which pass through that aperture. In order to minimize the effect of any defocusing in the analyzer plane which might occur as a consequence of a slight misalignment or inhomogenity of the directing electrostatic field, the smallest aperture (ie, that giving the highest resolution) may be disposed so that no directing field is needed for the charged particles to pass through it. The aperture corresponding to the lowest resolution may be located so that the greatest deflection is needed to cause the ions to pass through it, and any other apertures may be located intermediately between the narrowest and the widest apertures.

The apertures in the resolving member may be separated from one another by a solid portion of the resolving member, or may be joined to each other along an axis perpendicular to the analyzing plane to form a single elongated aperture having different widths at different distances from the plane. If such an elongated aperture is continuously tapered over at least a part of its length, an analyzer or spectrometer of continuously variable resolution may be provided.

In a still more preferred embodiment a single means for receiving (or detecting) the charged particles is provided but this may comprise two or more detectors. Means are also provided for directing the charged particles into either or any of the detectors, irrespective of which of the apertures they have passed through. For example, the means for receiving may comprise both an electron multiplier detector and a Faraday cage detector and be equipped with electrostatic deflecting means to cause charged particles received from any of the apertures in the resolving aperture member to be directed into either of the detectors. Typically the field generated by the electrostatic deflecting means is perpendicular to the field used to direct the charged particles through the chosen aperture. This results in very compact construction for the means for receiving.

BRIEF DESCRIPTION OF THE DRAWINGS

Preferred embodiments of the invention will now be described in greater detail and with reference to the figures, in which.

DESCRIPTION OF THE PREFERRED EMBODIMENTS

Figure 1A:
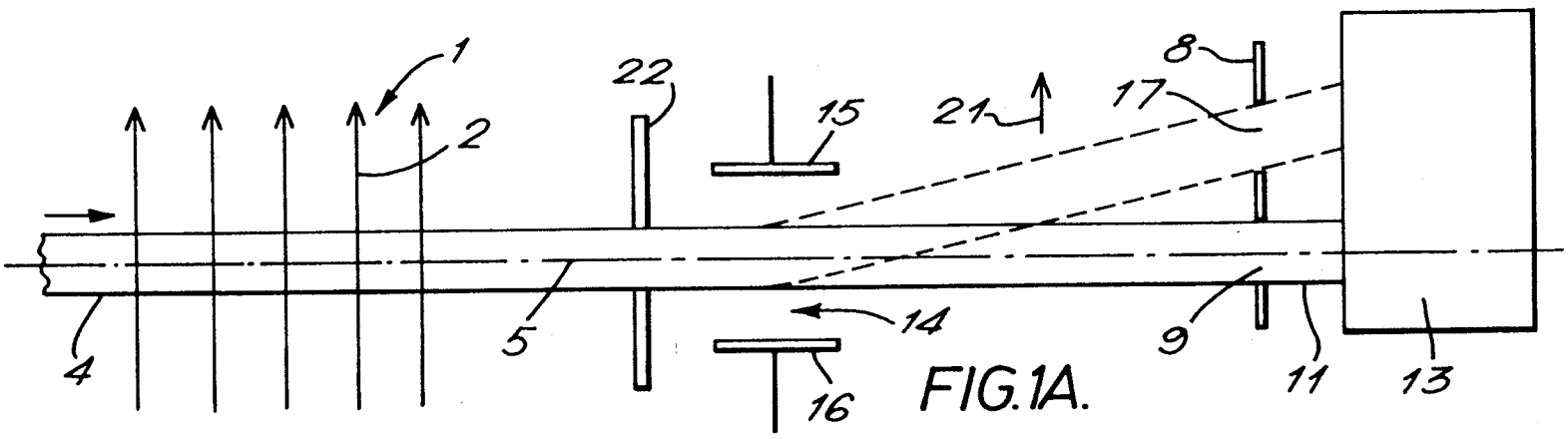
FIGS. 1A and 1B respectively show an elevation and a plan of the path of a beam of charged particles through an analyzer according to the invention.
Figure 1B:
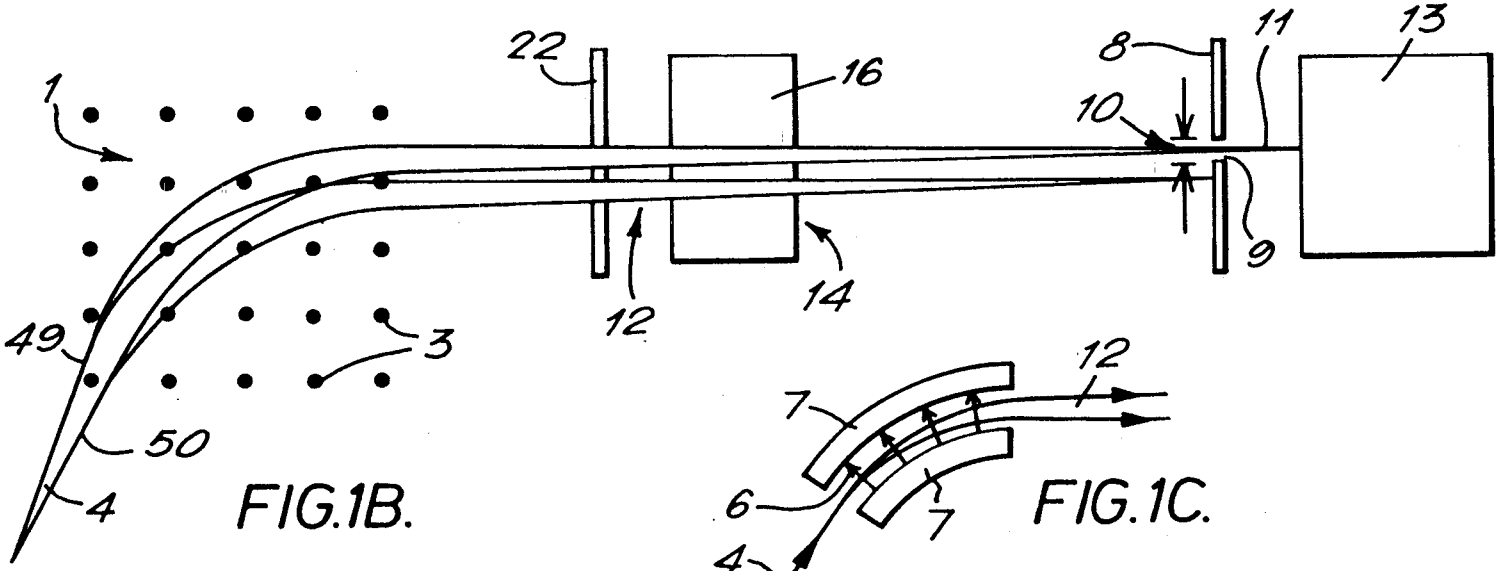
Figure 1C:
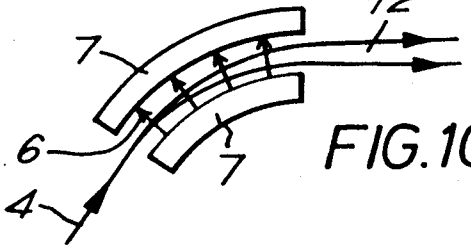
FIG. 1C is a plan view of part of the path of a beam of arged particles through an analyzer similar to the analyzer shown in FIGS. 1A and 1B but having a different type of analyzing field.

Referring first to FIGS. 1A and 1B, an analyzing field generally indicated by 1 and represented schematically by arrows 2 and the dots 3 in the elevation (FIG. 1A) and plan (FIG. 1B) respectively, causes dispersion of the charged particles 4 in an analyzing plane 5 or in planes parallel to plane 5, but causes substantially no dispersion in a direction 21 perpendicular to plane 5. The analyzing field 1 may cause dispersion of the charged particles in beam 4 according to their energy or according to their momentum. In the latter case, illustrated in FIGS. 1A and 1B, it is a magnetic field substantially perpendicular to the analyzing plane 5. In the former case may comprise an electrostatic field 6 formed between a pair of cylindrical sector electrodes 7, as shown in FIG. 1C.

A resolving aperture member 8 contains a plurality of apertures 9, 17 which are spaced apart along substantially perpendicular to the analyzing plane 5. Each aperture has a width 10 (measured in a plane parallel to the analyzing plane 5), which determines the resolution of the analyzing field 1 by allowing only a selected part 11 of the dispersed charged-particle beam 12 to pass through the member 8 to reach a means 13 for receiving charged particles. In most circumstances, means 13 comprises a charged-particle detector, but it may alternatively comprise, for example, an electrostatic lens system for transmitting charged particles to another device such as another analyzer.

Means 14 for directing at least some of the charged particles which have left the analyzing field 1 through any selected one of the apertures 9,17 typically comprise a pair of deflection electrodes 15,16 to which potentials are applied so that the beam is deflected as shown through the selected aperture. Aperture 9 is disposed so that charged particles leaving field 1 may pass through it undeflected by the means 14 and subsequently to the means 13 for receiving charged particles. This aperture should be the narrowest of the plurality of apertures, that is, the one which yields the highest resolution of the analyzer, so that any aberrations which might be introduced by operation of the means 14 are confined to lower selected resolutions where their effect will be less significant.

In the majority of cases, the analyzing field 1 will possess focusing properties as well as dispersive properties, so that for example, charged particles travelling along the two extreme trajectories 49 and 50 will be focused to the same point in an image plane. For optimum performance, the resolving aperture member 8 will be disposed so that at least one aperture 9,17 is aligned with that image plane.

Where the means 13 for receiving charged particles comprises a charged-particle detector such as an electron multiplier, channelplate or Faraday cage detector, its active area should extend sufficiently to receive charged particles from at least two of the apertures, eg 9 and 17, in the resolving aperture member 8. Where more apertures are provided it may be convenient to provide additional detectors, but in general it is preferred to receive all the charged particles on a single detector. To facilitate this, the means 13 may comprise a lens or beam deflection system to converge the charged particles from the apertures towards a detector with a relatively small active area.

Means 14 for directing the charged particles acts along an axis which is substantially perpendicular to the analyzing plane 5. This ensures that the component of the field generated by the means 14 in the analyzing plane 5 is substantially zero, so that it does not interfere with the dispersion of the charged particles in planes parallel to plane 5 by the analyzing field 1. The effect of any residual interference is however minimized by positioning the smallest (ie, the highest resolution) aperture in plane 5 so that it requires no directing field from means 14 for charged particles to pass through it.

Figure 2A:
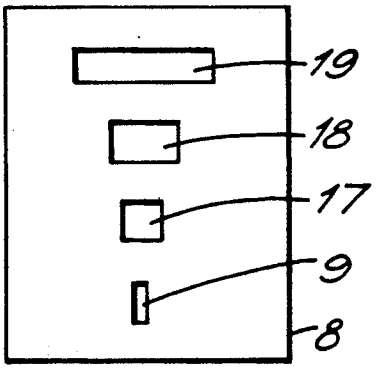
FIGS. 2A-2D illustrate various types of resolving aperture members suitable for use with the analyzer shown in FIGS. 1A, 1B and 1C.
Figure 2B:
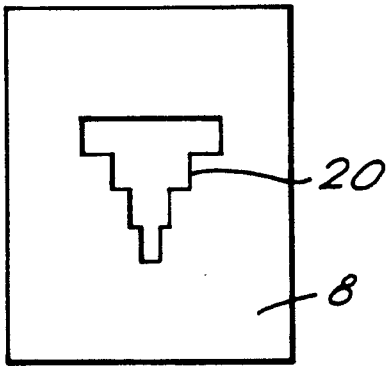

FIGS. 2A-2D illustrate a variety of embodiments of the resolving aperture member 8 which can be used in the invention. In FIG. 2A an aperture member 8 comprising four separate apertures 9, 17, 18 and 19 of different widths is shown. Each aperture 9, 17, 18 or 19 corresponds to a particular resolution of the analyzing field 1. In FIG. 2B a group of 4 apertures of different widths are arranged without separation into a stepped aperture 20 which provides four different resolutions by means of a smaller degree of beam deflection than the FIG. 2A member. However, a greater degree of beam collimation in a direction 21 perpendicular to plane 5 is required for the FIG. 2B member to prevent charged particles passing through apertures of different widths than the selected aperture reaching the means 13 for receiving charged particles. Collimation in the direction 21 may conveniently be provided by one or more beam height restrictors placed prior to the means 14 for directing, for example 22 (FIG. 1A).

Figure 2C:
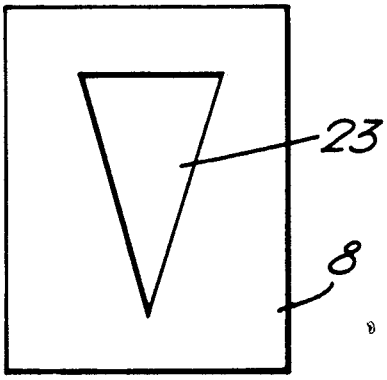
Figure 2D:
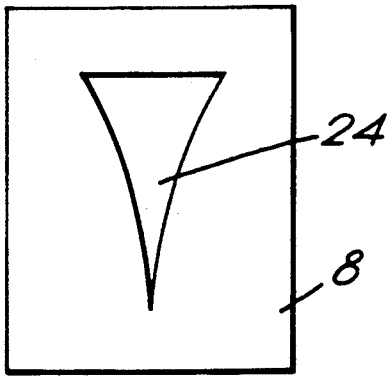

Use of a resolving aperture member 8 of the form shown in FIG. 2C or FIG. 2D allows a continuously variable resolution to be obtained, providing that the beam height is relatively small in comparison with the length of the tapered apertures 23 or 24. A simple triangular aperture 23 (FIG. 2C) may be used, wherein the slit width (and therefore the resolution) is approximately proportional to the degree of deflection of the beam out of the plane 5. A curved aperture 24 (FIG. 2D) is however, likely to yield better shaped peaks, especially when it is wide enough for the peaks to be "flat topped" in the lowest resolution position. It will be appreciated that other shapes of aperture in the member 8 may be more appropriate for other applications.

Figure 3:
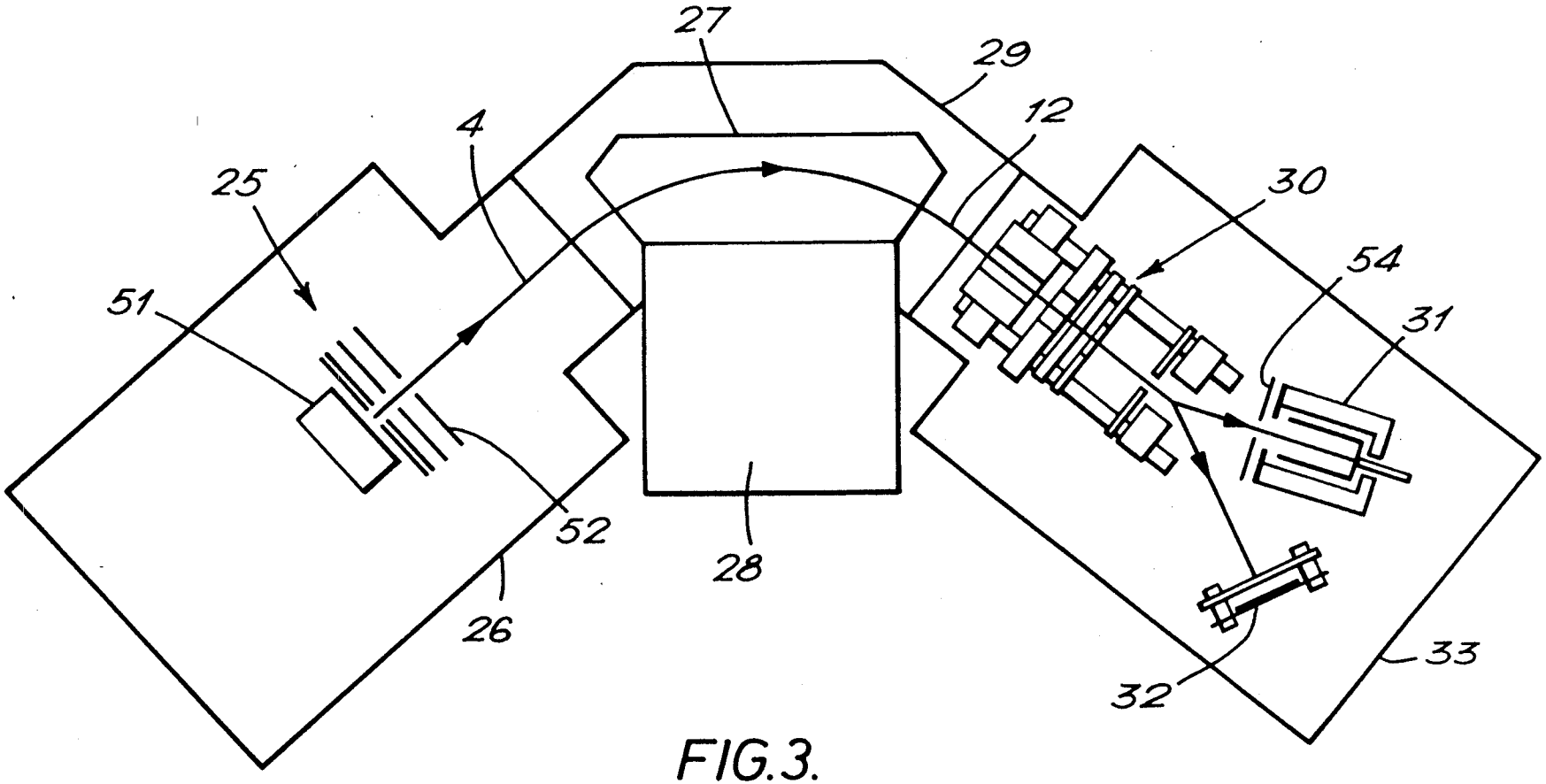
FIG. 3 is a schematic drawing of a mass spectrometer incorporating an analyzer according to the invention.

Referring next to FIG. 3, a mass spectrometer according to the invention comprises means 25 for generating a beam 4 of ions (for example, a conventional electron impact ion source). The ions in beam 4 are accelerated to a substantially constant energy by virtue of a fixed potential difference which is provided between the ion chamber 51 of the source and a grounded exit electrode 52. The ions comprised in beam 4 then enter an analyzing magnetic field generated between the poles 27 of an electromagnet 28. An evacuated envelope 29 contains apertures in its upper and lower surfaces which receive the electromagnet poles 27. Poles 27 are sealed into the apertures in the envelope 29 by means of gaskets to ensure that the envelope 29 is vacuum tight. In this way the instrument can be made more compact and the gap between the poles 27 can be minimized.

The electromagnet 28 separates the beam 4 into a dispersed beam 12 which passes into an electrode assembly 30 (described in detail below), which incorporates the resolving aperture member 8. After passing through the selected aperture in member 8 the ion beam is routed to either a Faraday cage detector 31 or a channelplate multiplier detector 32, as explained below. The electrode assembly 30 and detectors 31 and 32 are contained in an evacuated collector housing 33.

Figure 4:
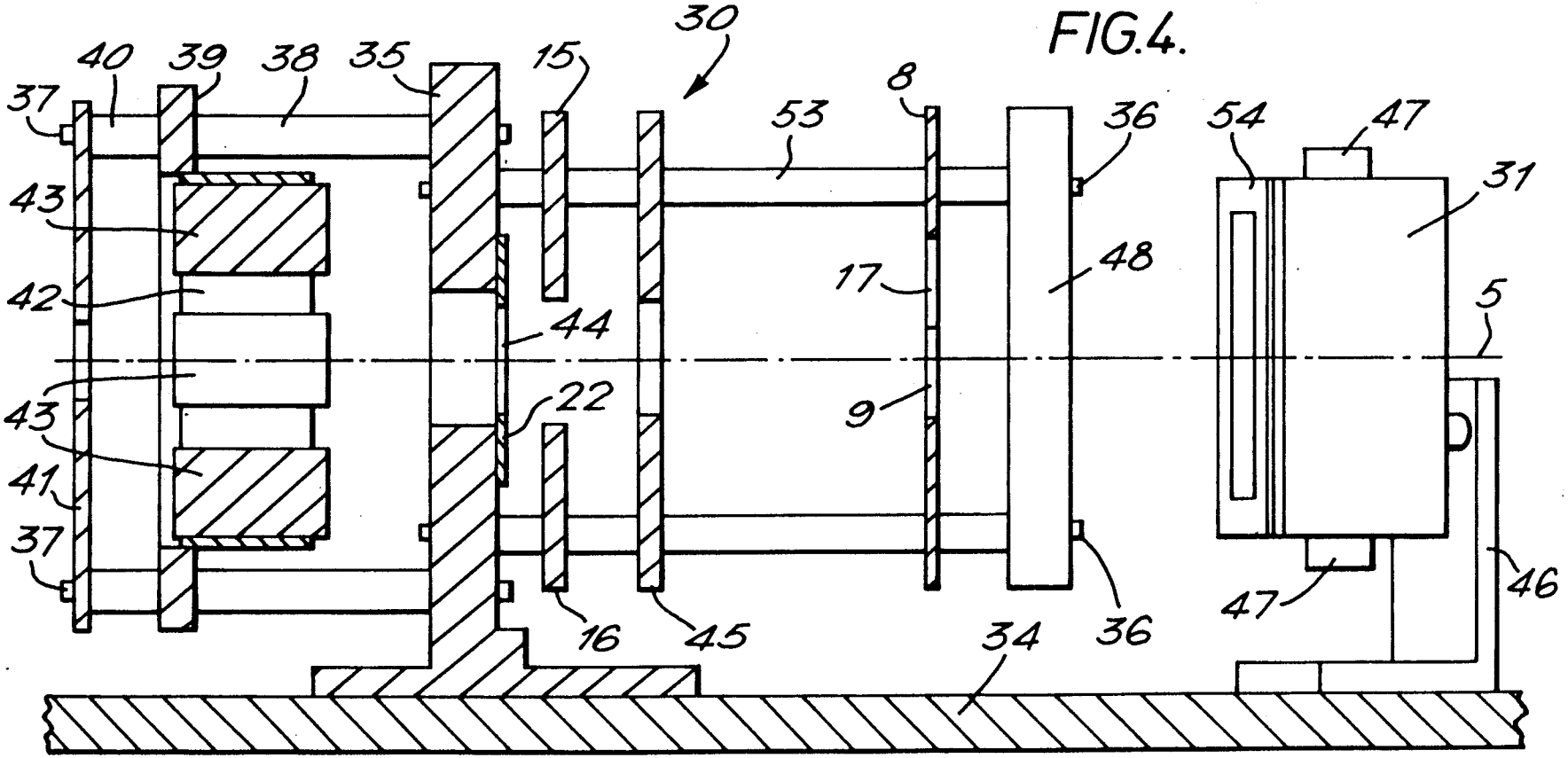
FIG. 4 is a detailed drawing of an electrode assembly used in the spectrometer of FIG. 3.

The electrode assembly 30 is shown in more detail in FIG. 4, which is a sectional elevation of the collector housing 33 of the spectrometer shown in FIG. 3. A mounting bracket 35 is secured to the base 34 of housing 33 and supports four insulating rods 36 and 4 metallic rods 37 which extend in opposite directions from the brackets 35. The four rods 37 carry metallic spacers 38 and 40, a lens supporting ring 39, and a grounded screen 41 made of stainless steel. The supporting ring 39 in turn carries an insulator 42 on which are mounted four short rod electrodes 43 which comprise a quadrupole electrostatic lens. This lens is supplied with potentials selected to optimize the focusing properties of the magnetic sector analyzer and is particularly useful in the spectrometer of FIG. 3 because the position of the poles 27 are fixed, thereby making it impossible to adjust the focal length of the analyzer in the conventional way (ie, by moving the poles 27 relative to the position of beam 4).

A beam height restrictor 22 comprising an aperture 44 is secured to the bracket 35. The height of aperture 44 (measured in a direction perpendicular to the analyzing plane 5) in conjunction with that of the aperture in the screen 41 provides a degree of ion beam collimation in the direction 21 (FIG. 1A) and allows the use of the compact style of aperture member 8 illustrated in FIG. 2B.

The insulating rods 36 carry the deflection electrodes 15 and 16 which are used for directing the beam through the appropriate aperture in member 8. Rods 36 also support a screen electrode 45 and a pair of 'Y' deflecting electrodes 48. Insulated spacers 53 are used to separate the various components on rods 36. The 'Y' deflecting electrodes 48 are used to direct the beam emerging from the selected aperture in member 8 towards whichever of the detectors 31 or 32 is required. Each of the detectors 31 and 32 is able to receive ions which have passed through any of the apertures in the member 8. The Faraday cage detector 31, visible in FIG. 4, is supported on a detector mounting bracket 46 and is conventional. It comprises a fully screened ion collecting cage fitted with magnets 47 and a negatively biased suppressor electrode 54 (FIG. 3) for minimizing the loss of secondary electrons which might otherwise cause errors in the measurement of the ion current. The channelplate multiplier detector 32 (visible only in FIG. 3) is also conventional and comprises a channelplate electron multiplier in front of a single plate-like collector electrode. This arrangement is used in preference to a conventional single-channel electron multiplier because the more extensive ion-sensitive area of the channelplate allows the detector to receive ions from all of the apertures in member 8 without significant loss of sensitivity.

In use, the ion beam emerging from member 8 is directed into the chosen detector by application of a potential difference between the 'Y'-deflecting electrodes 48. As is conventional, the Faraday cage detector 31 is used when an accurate measurement of ion current is required, and the multiplier detector 32 is used when a fast response is required, for example, when scanning the mass spectrum quickly.

A typical application of the spectrometer represented in FIGS. 3 and 4 is the quantitive analysis of a mixture of gases for which the maximum mass resolution required is about 200. In this application, the resolving aperture member 8 requires only two apertures of different width, one, in the plane 5, giving a resolution of 200 and the other a resolution of about 100, so that measurements of ions of mass-to-charge ratios up to 100 are made using the wider aperture and of mass-to-charge ratios from 100 to 200 are made using the narrower aperture. Both apertures may be sufficiently wide for the peaks to be flat-topped, thereby minimizing the accuracy to which the peaks need to be centred on the aperture while their height is determined and consequently easing the long-term stability requirements of the analyzer and its power supplies.

In these circumstances, aberrations which might result from the deflection of beam out of plane 5 to pass through the wider aperture in member 8 are insignificant so that the angular deflections can be made quite large. This leads to a very compact detector structure, but it will be appreciated that the invention is also applicable to much higher resolution spectrometers. At higher resolution, however, it may be necessary to limit the maximum angle of deflection in order to keep the aberrations to a sufficiently low value, which in turn will necessitate a lengthening of the distance between the deflector electrodes 15 and 16 and the resolving aperture member 8. This must be considered when focusing properties of the spectrometer are designed because the member 8 is typically located in the image plane of the spectrometer.

What is claimed is:

1. A method of analyzing a beam of charged particles according to a property chosen from the group comprising energy and momentum, said method comprising:

a) causing the charged particles to enter an analyzing field wherein they are dispersed according to the chosen property in an analyzing plane but are not substantially dispersed in a direction perpendicular to said analyzing plane, and b) passing at least some of the charged particles leaving said analyzing field through an aperture whose width is chosen to determine the resolution of said analyzing field with respect to said chosen property, the improvement wherein at least some of the charged particles leaving said analyzing field are directed through any selected one of a plurality of said apertures of different widths spaced at different distances from said analyzing plane, whereby the resolution of said analyzing field is varied according to which said aperture is selected.

2. A method as claimed in claim 1 wherein said charged particles may be directed through either of two said apertures and subsequently to a single means for receiving charged particles.

3. A method as claimed in claim 1 wherein said chosen property is momentum and said analyzing field comprises a magnetic field, whereby the mass resolution of said magnetic field is determined according to which of said apertures is selected.

4. A method as claimed in claim 1 wherein said analyzing field focuses said charged particles at least along one axis in an image plane in which at least one of said apertures is disposed.

5. A selectable-resolution analyzer for analyzing a beam of charged particles according to a property chosen from the group comprising energy and momentum, said analyzer comprising:

a) means for creating an analyzing field which disperses said particles according to said property in an analyzing plane but does not substantially disperse said charged particles in a direction perpendicular to said analyzing plane;

b) means for causing a beam of charged particles to enter said analyzing field and to be dispersed therein according to said chosen property; and c) a resolving aperture member disposed at the exit of said analyzing field comprising at least an aperture whose width is chosen to determine the resolution of said analyzing field with respect to said property, through which aperture pass at least some charged particles after they have left said analyzing field, the improvement comprising a) the provision in said resolving aperture member of a plurality of said apertures of different widths each spaced at a different distance from said analyzing plane, and b) means for directing at least some of the charged particles leaving said analyzing field through any selected one of said plurality of apertures whereby the resolution of said analyzer is determined according to which of said apertures is selected.

6. A selectable-resolution analyzer is claimed in claim 5 wherein a single means for receiving charged particles is disposed to receive particles which have passed through either of at least two of said plurality of apertures.

7. In a selectable resolution mass spectrometer, the spectrometer comprising means for generating a beam of ions and accelerating the ions comprising the beam to a substantially constant energy, said spectrometer also comprising means for creating a magnetic field for dispersing the ions in the beam according to momentum in an analyzing plane without substantial dispersion in a direction perpendicular to said plane, said spectrometer further comprising a resolving aperture member disposed in the path of ions exiting the magnetic field, said resolving aperture member including a first aperture having a width chosen to determine a resolution of the mass spectrometer with respect to momentum, at least some of the ions in the beam passing through said first aperture after exiting the magnetic field, the improvement comprising:

a) at least a second aperture in the resolving aperture member, said second aperture having a width which is different from the width of said first aperture, said first and second apertures being spaced at different distances from the analyzing, plane, the width of said second aperture being selected to define a resolution of the mass spectrometer with respect to momentum; and b) means for directing at least some of the ions having the magnetic field through a selected one of said apertures whereby the resolution of the mass spectrometer is determined according to which of said apertures is selected.

8. A selectable-resolution mass spectrometer as claimed in claim 7 wherein said magnetic field focuses ions of different mass-to-charge ratios in an image plane, and at least one of said apertures is disposed said image plane.

9. A selectable-resolution mass spectrometer as claimed in claim 7 wherein said resolving aperture member comprises two apertures of different widths separated from one another and disposed at different distances from said analyzing plane.

10. A selectable-resolution mass spectrometer as claimed in claim 7 wherein the apertures in said resolving aperture member are disposed one above the other along an axis substantially perpendicular to said analyzing plane and said means for directing at least some of the charged particles comprises an electrostatic field in the same direction as said axis, which field may be adjusted to direct the charged particles through any selected one of said apertures.

11. A selectable-resolution mass spectrometer as claimed in claim 8 wherein the apertures in said resolving aperture member are disposed one above the other along an axis substantially perpendicular to said analyzing plane and said means for directing at least some of the charged particles comprises an electrostatic field in the same direction as said axis, which field may be adjusted to direct the charged particles through any selected one of said apertures.

12. A selectable-resolution mass spectrometer as claimed in claim 9 wherein the apertures in said resolving aperture member are disposed one above the other along an axis substantially perpendicular to said analyzing plane and said means for directing at least some of the charged particles comprises an electrostatic field in the same direction as said axis, which field may be adjusted to direct the charged particles through any selected one of said apertures.

13. A selectable-resolution mass spectrometer as claimed in claim 7 further comprising means for detecting ions, disposed to receive ions which have passed through either of at least two of said plurality of apertures.

14. A selectable-resolution mass spectrometer as claimed in claim 13 wherein said means for detecting ions comprises both an electron multiplier and a Faraday cage detector, and wherein means are provided for directing the ions after they have passed through any selected one of said plurality of apertures into either of said electron multiplier or said Faraday cage detector.

15. A selectable-resolution mass spectrometer as claimed in claim 14 wherein said means for directing the ions after they have passed through any selected aperture comprises an electrostatic field which may be adjusted to direct the ions into either said electron multiplier or said Faraday cage detector.

16. A selectable-resolution mass spectrometer as claimed in claim 10 further comprising means(for detecting ions, disposed to receive ions which have passed through either of at least two of said plurality of apertures.

17. A selectable-resolution mass spectrometer as claimed in claim 16 wherein said means for detecting ions comprises both an electron multiplier and a Faraday cage detector, and wherein means are provided for directing the ions after they have passed through any selected one of said plurality of apertures into either of said electron multiplier or said Faraday cage detector.

18. A selectable-resolution mass spectrometer as claimed in claim 17 wherein said means for directing the ions after they have passed through any selected aperture comprises an electrostatic field which may be adjusted to direct the ions into either said electron multiplier or said Faraday cage detector.

* * * * *